United States Patent [19]

Bischoff

[11] 4,102,601

[45] Jul. 25, 1978

[54] FORCED DRAFT FAN BLADE CONSTRUCTION FOR DYNAMO ELECTRIC MACHINES AND FORCED DRAFT AUTOMOTIVE ALTERNATOR

[75] Inventor: Guido Bischoff, Schwieberdingen, Fed. Rep. of Germany

[73] Assignee: Robert Bosch GmbH, Stuttgart, Fed. Rep. of Germany

[21] Appl. No.: 689,748

[22] Filed: May 25, 1976

[30] Foreign Application Priority Data

Jul. 17, 1975 [DE] Fed. Rep. of Germany ..... 2531889

[51] Int. Cl.[2] ..... F04D 29/20

[52] U.S. Cl. ..... 416/183; 416/60; 416/214 R; 416/DIG. 3

[58] Field of Search ..... 416/135, 169, 183, 214, 416/169 A, 214 A, DIG. 3, 60, 181, 185, DIG. 3, 93; 403/373, 259, 257, 261, 374; 417/353, 354

[56] References Cited

U.S. PATENT DOCUMENTS

| | | | |
|---|---|---|---|
| 460,233 | 9/1891 | Kennedy | 416/60 |
| 1,023,272 | 4/1912 | Oakes | 416/DIG. 3 |
| 1,542,412 | 6/1925 | Reed | 416/214 |
| 1,634,554 | 7/1927 | Pajalic | 416/DIG. 3 |
| 2,161,881 | 6/1939 | Musolf | 416/214 |
| 2,222,118 | 11/1940 | Newnham | 416/214 |
| 2,633,008 | 3/1953 | Guilbert | 416/134 |
| 2,726,524 | 12/1955 | Gorin | 416/214 X |
| 2,800,967 | 7/1957 | Fogel | 416/60 X |
| 2,827,225 | 3/1958 | Killian | 416/DIG. 3 X |
| 2,906,349 | 9/1959 | Hans et al. | 416/135 |
| 2,955,748 | 10/1960 | Killian | 416/DIG. 3 X |
| 3,952,712 | 4/1976 | Hermanson | 416/60 X |

FOREIGN PATENT DOCUMENTS

| | | | |
|---|---|---|---|
| 74,422 | 7/1918 | Austria | 416/135 |
| 1,053,712 | 3/1959 | Fed. Rep. of Germany | 416/244 |
| 762,625 | 3/1954 | Fed. Rep. of Germany | 416/DIG. 3 |
| 923,521 | 2/1955 | Fed. Rep. of Germany | 416/135 |
| 2,434,744 | 1/1976 | Fed. Rep. of Germany | 416/214 |
| 127,355 | 6/1919 | United Kingdom | 416/214 |
| 830,385 | 3/1960 | United Kingdom | 416/214 |

*Primary Examiner*—Everette A. Powell, Jr.
*Attorney, Agent, or Firm*—Flynn & Frishauf

[57] ABSTRACT

To improve the reliability of a fan blade to provide forced cooling to automotive-type alternators, while retaining the advantages of compact construction and inexpensive manufacture, a disk-shaped element is formed with a central opening to receive the shaft of the alternator having fan blades at the periphery thereof, and which further is so shaped and formed that the central region is axially (with respect to the shaft) offset from the major plane of the disk-shaped fan blade, clamping washers being placed against the offset region, one washer spanning the concave portion of the offset portion and the other washer fitting within the concave portion of the offset.

13 Claims, 3 Drawing Figures

FORCED DRAFT FAN BLADE CONSTRUCTION FOR DYNAMO ELECTRIC MACHINES AND FORCED DRAFT AUTOMOTIVE ALTERNATOR

The present invention relates to a cooling fan blade construction and more particularly to a fan blade construction for use in or combination with dynamoelectric machines, for example automotive alternators to provide forced draft cooling therefor.

The speed range, and particularly maximum speed of automotive-type alternators continues to increase, resulting in increased dynamic stresses on the various components of the alternator and particularly on forced draft fan blades therefor which have a comparatively large diameter with respect to the overall size of the alternator. Due to the increased loading requirement placed on the fan blade, and particularly when the fan blades are made as stamped constructions from disks, oscillations in axial direction may result. The fan blade disks are customarily clamped to the alternator shaft. If the disk element is subject to axial oscillations, breakage may result at the clamping points, which breakage is not due to excessive loading as a result of centrifugal force, but rather is due to the axial vibration imparted to the fan blade, Upon such breakage, fractured elements of the fan blade are centrifugally flung out, which causes damage to the fan construction, damage to the alternator, and may lead to personal injury.

Various solutions have been proposed in order to avoid damage to the alternator, and possible consequential damages and injuries resulting from breakage of the fan blade disk where it is clamped to the shaft. One solution is to increase the counter washer placed, customarily, against the fan blade at the side thereof facing the drive pulley of the alternator. Increasing the size of this washer does improve the resistance of the disk against breakage but introduces additional disadvantages. For example, the alignment of the drive pulley, and hence of the drive belt is changed, so that the drive belt no longer runs in a single operating plane, since the drive pulley is moved farther away from the fan by the thickness or increased thickness of the counter washer. If the drive belt does not run true in a single plane, additional wear and tear is placed thereon. While the drive belt can be aligned by suitable re-design of the attachment elements of the alternator within a vehicle, it detracts from ready interchangeability of parts which are subject to service and replacement. Furthermore, increasing the counter washer in diameter and thickness additionally increases the material costs of the overall structure.

It has also been previously proposed to construct diskshaped fan blades by offsetting the peripheral region of the fan blade with respect to the remainder thereof. This changes the center of gravity of the fan blade disk to a location essentially in the plane of clamping of the disk. This measure prevents torsional stresses being placed on the disk by centrifugal force, particularly when the fan is operating at a higher speed. While such an arrangement increases the resistance against vibration, resonant oscillations arose in such fan blade constructions causing failure of the fan blades in the zone surrounding the hole through which the shaft passes.

It is an object of the present invention to provide a forced draft cooling fan blade construction, particularly for use in or in combination with an automotive-type alternator, which is inexpensive and reliable and in which the disadvantages of the prior art are effectively avoided.

SUBJECT MATTER OF THE PRESENT INVENTION

Briefly, the disk-shaped element is generally flat formed with an axial (with respect to the shaft direction) offset from the major plane thereof which surrounds the central opening and is located adjacent thereto. The axially offset region forms a concentric shallow dish-shaped depression at one side of the disk-shaped element in a zone surrounding the shaft opening, and a convex region at the other side thereof. Preferably, clamping washers are placed against the element at either side, one washer for example spanning the concave depression and the other washer fitting against the convex projection; the washer fitting against the convex projection may bear against an end bearing of the shaft of the alternator.

The fan blade construction and the alternator-fan-blade combination has the advantage that the material costs and manufacturing costs are not increased; the dimensions of the generator, further, are not changed so that exact interchangeability of an alternator with the improved fan blade with respect to alternators of the prior art is obtained. The alternators are substantially more reliable, however, since the resistance against vibration, shock, oscillation and resonant oscillation in axial direction is substantially improved. When placing counter washers against the offset portion, the counter washing can be so dimensioned that a minimum quantity of material is used, while providing maximum bearing surfaces to clamp the fan blade reliably to the shaft. A higher torque can be transferred by frictional engagement of the fan blade with the shaft than with prior art constructions, if such is desired. By suitably dimensioning the offset zone, the resonance of the fan blade can be placed in a frequency region which is outside of the operating range thereof, so that the fan blade is not subjected to resonant vibrations or oscillations; as a result, the operating noise of the alternator as a whole is decreased.

The invention will be described by way of example with reference to the accompanying drawings, wherein.

Figure 3:
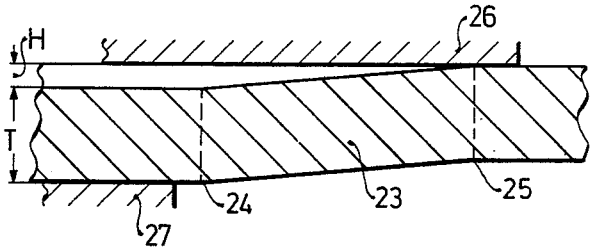

and FIG. 3 is a greatly enlarged fragmentary view of the central, offset region of the fan blade and associated bearing washers.

Fan body 11 (FIG. 1) can be constructed with fan elements 12, 13, 15 of different design; in many constructions, however, any one fan disk is advantageously provided with only one type of blade. The plurality of blades illustrated in FIG. 1, however, shows the versatility of the fan blade in accordance with the present invention.

Blades 13, 15 are reinforced by a stiffening crimp 14. The stiffening crimp 14 extends from the plane of the fan disk 11 in approximately trapeze-shaped cross section. The portions of the base of the blades 17, 18 are in the plane of the disk-shaped fan body 11. The stiffening crimp 14 is formed by punching or stamping the portions 16, 19 from the plane of the disk-shaped body 11.

The cross-sectional area of the regions 17, 18 should be approximately the same size as the cross-sectional area of the region 16.

Figure 1:
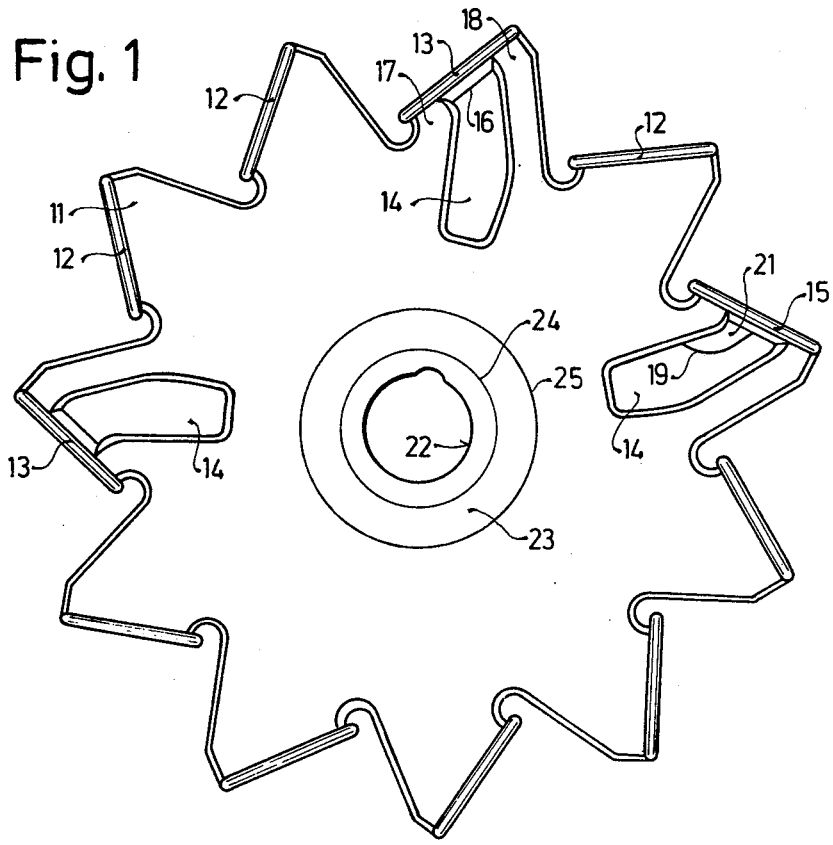
FIG. 1 is a plan view of the fan blade in accordance with the present invention.

The disk-shaped fan body 11 is formed with a central offset region 23. The offset is in axial direction - with respect to the shaft axis - and extends gradually, that is, not abruptly, from a circumferential zone surrounding the central opening 22 of the fan disk 11. The central, offset region 23 is defined by an inner limit or ridge 24 and an outer ridge 25 (FIGS. 1, 3).

Figure 2:
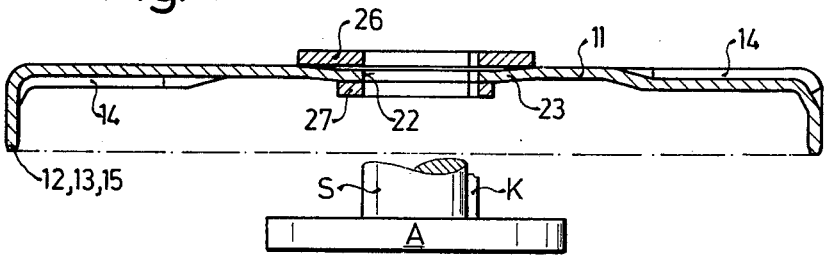
FIG. 2 is a transverse sectional view of the fan blade with washers assembled thereto and, in exploded form, schematically showing the assembly to an alternator structure.

The fan disk is associated with an alternator of any suitable and known construction, schematically merely shown as block A. Shaft S formed with a key K extends from the alternator A. The various elements of the alternator themselves have been omitted since they can be conventional. A pulley (not shown) is placed on the shaft S at the upper side (FIG. 2) of disk 11. A washer 26 is located at the side of the disk 11 where the central offset forms a concave portion. Washer 26 has a diameter which is somewhat greater than the diameter of the deformed offset region, as best seen in FIG. 3, which shows an overlap of washer 26 beyond the outer limit 25 of the offset region 23. An inner washer 27 is located at the alternator side of the fan disk 11. The diameter of the washer 27 is less than the diameter of the inner limit 24 of the offset region 25. The lower side (FIG. 3) of washer 27 can bear against a race of the ball bearing included in alternator A and supporting shaft S. If desired, only washer 27 need be formed with a key slot to receive key K, or with a projection fitting into a slot formed in the shaft.

The height H (FIG. 3) of the offset 23 is approximately 0.3 mm. The dished shape of the disk element 11 is clearly seen in FIG. 3, which also shows the placement of the counter washers. Although the offset is small - shown highly exaggerated in the drawings - failure of the fan or blower disk 11 due to axial vibration or stresses is reliably avoided.

The depth H of the offset 23 is small with respect to the thickness T (FIG. 3) of the material forming the disk 11.

Various changes and modifications may be made within the scope of the inventive concept.

I claim:

1. Fan blade construction for dynamoelectric machines to provide forced air cooling for the machine comprising an essentially flat disk-shaped element (11) formed with a central opening (22) for mounting the element on a shaft (S) and fan blades (12–15) formed on the periphery of the disk-shaped element (11), wherein the disk-shaped element (11) is formed with a central region (23) which is axially offset from the major plane of the disk-shaped element by a distance (H) less than the thickness (T) of the material of the disk-shaped element to form a shallow, concave depression at one side thereof and a dish-shaped bulge at the other side thereof, said central offset region surrounding the central opening (22).

2. Fan blade construction according to claim 1, further comprising clamping disk means (26, 27) bearing against at least one side of the disk-shaped element (11) to clamp the element on the shaft (S).

3. Fan blade construction according to claim 1, further comprising a clamping washer (26) bearing against the side of the disk-shaped element which is concave, spanning the concave depression and extending into engagement with the disk-shaped element beyond said depression.

4. Fan blade construction according to claim 1, further comprising a clamping washer (27) bearing against the side of the disk-shaped element which is convex, fitting against the convex depression and extending into engagement with the disk-shaped element only in the region of said bulge, the diameter of said clamping washer being less than the diameter of the convex bulge.

5. Fan blade construction according to claim 3, further comprising a second clamping washer (27) bearing against the side of the disk-shaped element which is convex, fitting against the convex depression and extending into engagement with the disk-shaped element only in the region of said bulge, the diameter of said second clamping washer being less than the diameter of the convex bulge.

6. Fan blade construction according to claim 5, wherein the offset is in the order of approximately 0.3 mm.

7. Fan blade construction according to claim 5, wherein the offset extends gradually from the major plane of the disk-shaped element to a second central plane, essentially parallel with said major plane and offset therefrom.

8. Fan blade construction according to claim 1, wherein the depth (H) of the offset of the central region (23) is small in comparison to the thickness (T) of the material of the disk-shaped element (11).

9. Forced draft automotive type alternator, wherein the alternator forms the dynamoelectric machine having a fan blade comprising the construction of claim 5.

10. Forced draft automotive type alternator wherein the alternator forms the dynamoelectric machine, having a fan blade comprising the construction of claim 5.

11. Forced draft automotive-type alternator, wherein the alternator forms the dynamoelectric machine, having a fan blade comprising the construction of claim 7, and wherein said planes are spaced by a distance of approximately in the order of 0.3 mm.

12. Fan blade construction according to claim 5, wherein the depth (H) of the offset of the central region (23) is small in comparison to the thickness (T) of the material of the disk-shaped element (11).

13. Fan blade construction according to claim 12, wherein the offset is in the order of approximately 0.3 mm.

* * * * *